United States Patent [19]

Swanson

[11] 4,293,290

[45] Oct. 6, 1981

[54] POSITIVE DISPLACEMENT ROTARY PUMP WITH BEARINGS IN COUNTERSUNK PORTIONS OF THE ROTORS

[75] Inventor: Victor E. Swanson, Fort Atkinson, Wis.

[73] Assignee: Crepaco, Inc., Lake Mills, Wis.

[21] Appl. No.: 36,030

[22] Filed: May 4, 1979

[51] Int. Cl.[3] ..... F04C 2/18; F04C 15/00

[52] U.S. Cl. ..... 418/94; 418/142; 418/144; 418/181; 418/206

[58] Field of Search ..... 418/94, 181, 191, 205, 418/206, 142, 144

[56] References Cited

U.S. PATENT DOCUMENTS

| | | | |
|---|---|---|---|
| 1,834,976 | 12/1931 | Schmidt | 418/94 |
| 2,279,136 | 4/1942 | Funk | 418/70 |
| 3,133,506 | 5/1964 | Luciani | 418/206 |
| 3,417,915 | 12/1968 | Granberg | 418/94 |

FOREIGN PATENT DOCUMENTS

| | | | |
|---|---|---|---|
| 971424 | 7/1975 | Canada | 418/205 |
| 673007 | 3/1939 | Fed. Rep. of Germany | 418/206 |
| 897770 | 11/1953 | Fed. Rep. of Germany | 418/206 |
| 16098 | of 1908 | United Kingdom | 418/206 |
| 265701 | 6/1970 | U.S.S.R. | 418/206 |

*Primary Examiner*—John J. Vrablik

*Attorney, Agent, or Firm*—Neuman, Williams, Anderson & Olson

[57] ABSTRACT

A positive displacement rotary pump is provided for use in circulating a viscous product at high pressures. The pump includes a housing having a product inlet and a product outlet communicating with an interior cavity. One wall of the cavity is defined by a removable cover. A pair of spaced substantially parallel shafts extends through a wall of the cavity opposite the cover wall. One end of each shaft is supported by the cover. A pair of meshing rotors is locked on the shafts and disposed uniformly within the cavity. The endface of each rotor adjacent the removable cover has a substantial countersunk portion. Bearing means, substantially isolated from the product, is disposed within each rotor endface countersunk portion and supportingly engages a segment of the rotor shaft one end. At least a portion of each bearing means is located between planes defined by the surfaces of the cover and the wall opposite thereto which coacts to form the cavity. Means for supporting the bearing means is removably mounted on the cover.

1 Claim, 6 Drawing Figures

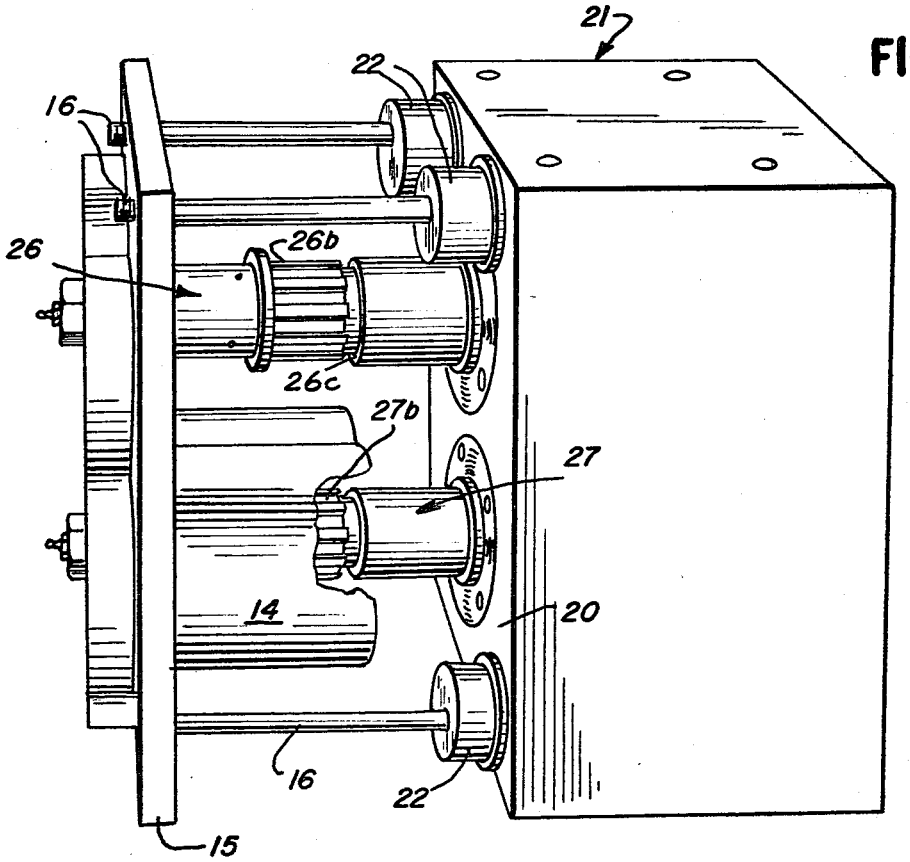
FIG. 2
FIG. 3
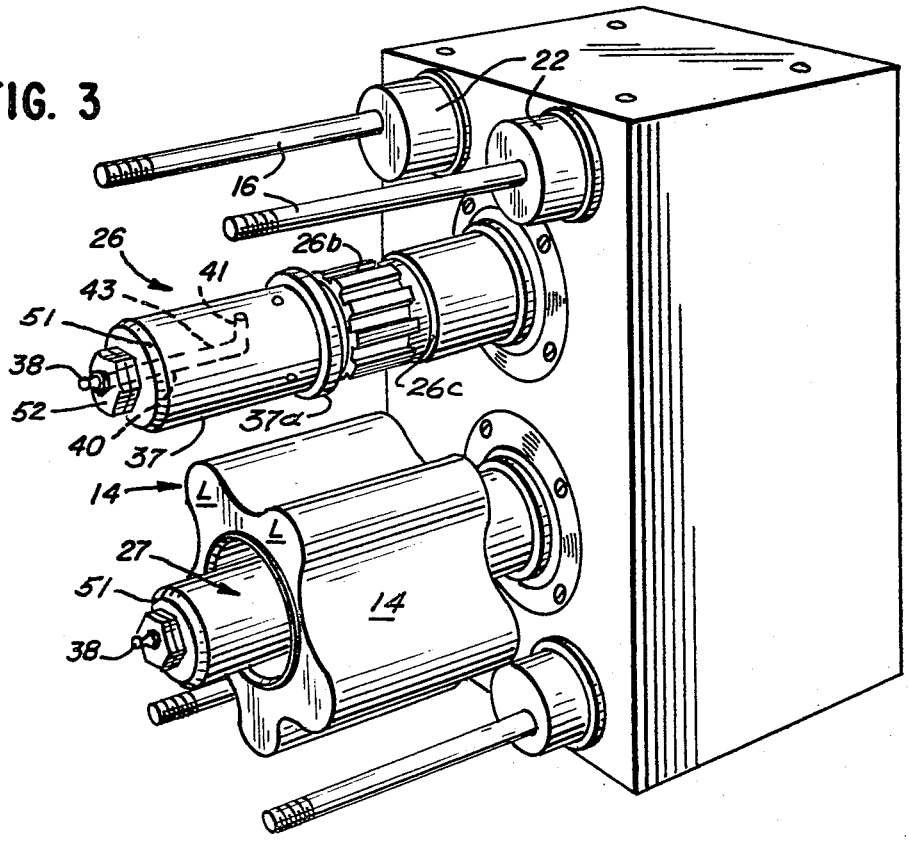

POSITIVE DISPLACEMENT ROTARY PUMP WITH BEARINGS IN COUNTERSUNK PORTIONS OF THE ROTORS

BACKGROUND OF THE INVENTION

Various positive displacement rotary pumps have heretofore been provided for circulating various viscosity products; however, such pumps have been ineffective in handling such products at pressures within the range of 200–350 psi. When operating within such a pressure range, such pumps have been beset with one or more of the following shortcomings: (a) serious shaft deflection occurs; (b) an inordinate amount of bearing wear results; (c) serious galling between the rotors and the cavity surfaces; (d) the rotors are higly susceptible to product corrosion and product abrasiveness; (e) the shafts are not effectively isolated from the product thereby causing the potential for serious contamination problems; and (f) makes disassembly of the pump for cleaning and maintenance a difficult and time-consuming operation.

SUMMARY OF THE INVENTION

Thus, it is an object of the invention to provide a positive displacement rotary pump which is capable of operating within a pressure range of 0–350 psi while circulating products of various viscosities without encountering the aforenoted problems.

It is a further object of the invention to provide a positive displacement rotary pump wherein the shaft-supported rotors are interchangeable and, thus, facilitate assembly and disassembly of the pump.

It is a further object of the invention to provide a positive displacement rotary pump having means for locating and adjusting the shafts thereof so as to maintain uniform rotor clearances within the pump cavity.

It is a further object of the invention to provide a positive displacement rotary pump wherein the relative location of one bearing of each rotor shaft with respect to the axial centerline of the rotor is such that a substantial mechanical advantage is obtained thereby significantly reducing shaft deflection when the rotor is subjected to substantial downstream pressure of the circulating product.

It is a still further object of the invention to provide a pump of the type described which is of compact construction; is efficient in operation; and the rotor shafts are effectively isolated from the circulating product by seals vented to the atmosphere thereby permitting the flushing of the atmosphere side of the seal with a productcompatible fluid or a sterile fluid when the pump is being in aseptic application.

It is a still further object of the invention to provide a positive displacement rotary pump which is capable of handling a wide variety of highly viscous, corrosive and abrasive products.

Further and additional objects will appear from the description, accompanying drawings and appended claims.

In accordance with one embodiment of the invention, a positive displacement rotary pump is provided for use in circulating a viscous product at high pressures (e.g., 200–350 psi). The pump includes a housing having a product inlet and a product outlet, both of which communicate with an interior cavity. One wall of the cavity is defined by a removable cover. A pair of spaced, substantially parallel shafts extend into the cavity from the cavity wall opposite the cover wall and have end portions thereof supported by the cover. Each shaft is driven by a first means which is isolated from the cavity. Meshing rotors are locked on the shafts and are diposed within the cavity. The endface of each rotor, which is disposed adjacent the cover wall, is provided with a substantial countersunk portion. Disposed within each countersunk portion and supportingly engaging segments of the shaft is a bearing means which is isolated from the product. Each bearing means has at least a portion thereof located between planes defined by the surfaces of the cover and the wall opposite thereto which form the cavity. A second means is carried by the cover and supports the bearing means. The engagements between the shafts and rotors are isolated from the product during operation of the pump.

DESCRIPTION

For a more complete understanding of the invention reference should be made to the drawings wherein:

FIG. 2 is a fragmentary side perspective view of the pump of FIG. 1 but with a portion of the housing removed and the upper rotor removed from the shaft.

FIG. 3 is a similar to FIG. 2 but showing the cover and one of the rotors removed.

Figure 1:
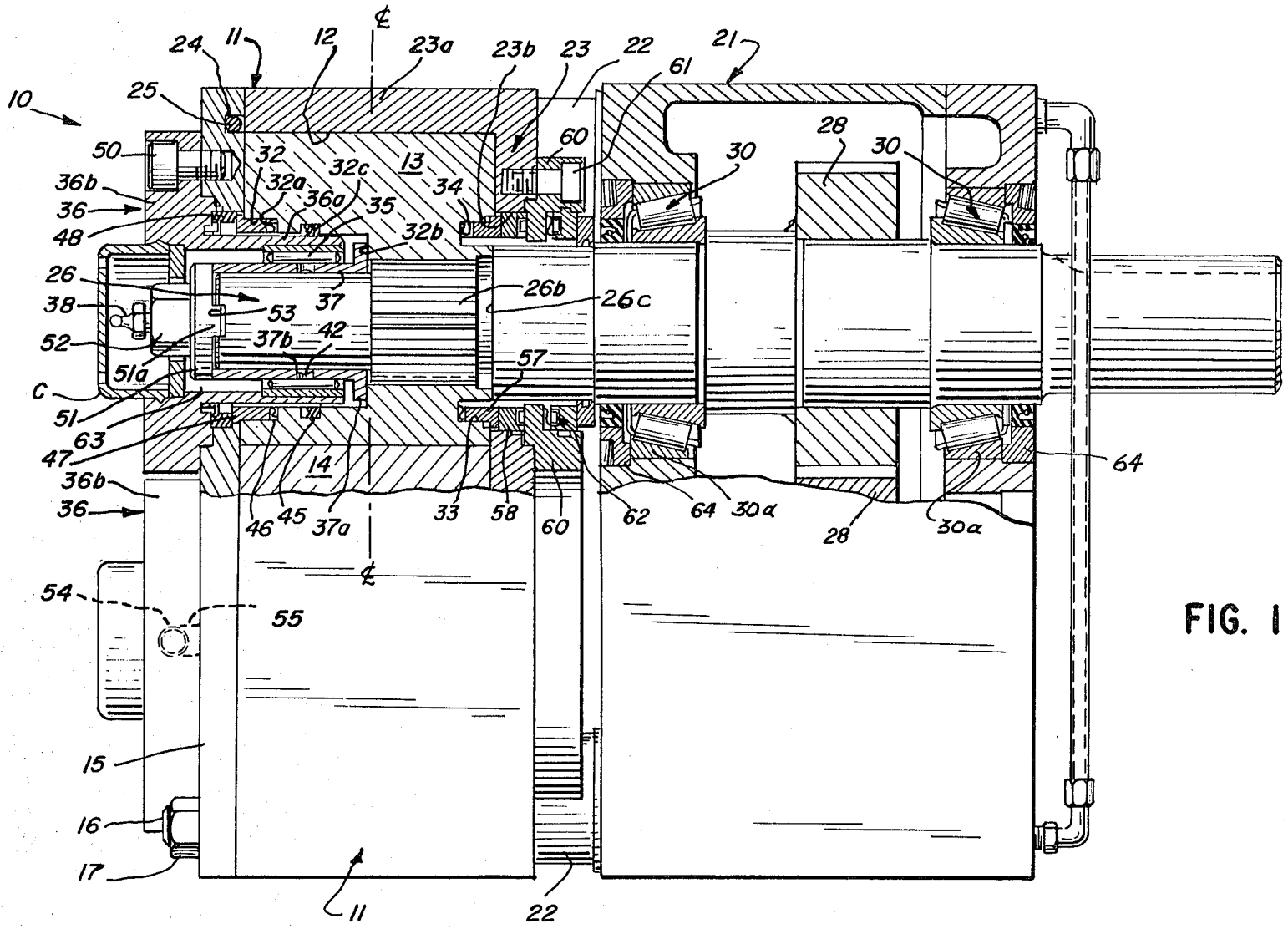
FIG. 1 is an enlarged fragmentary side elevational view partially in section of one form of the improved positive displacement rotary pump; the plane of the section including the rotary axes of the rotor shafts.
Figure 4:
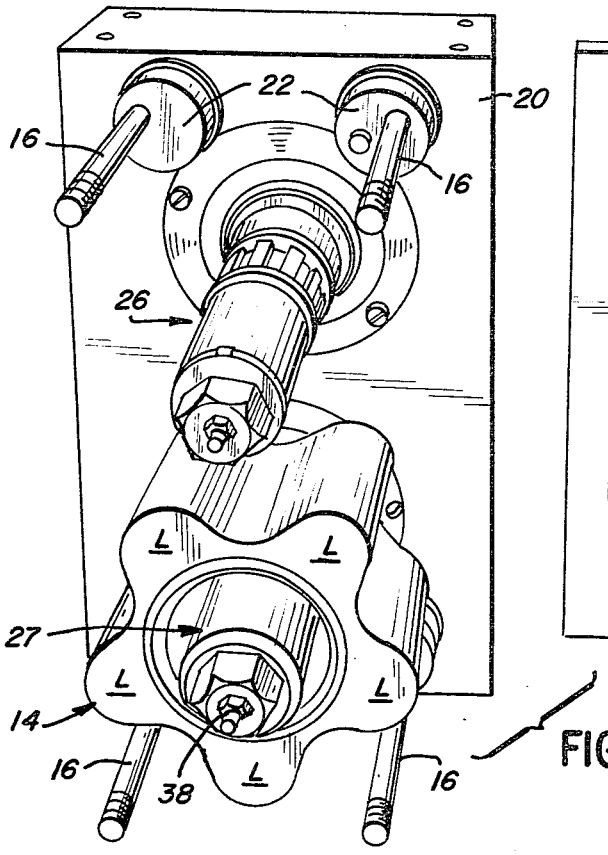
FIG. 4 is a fragmentary front perspective view of FIG. 3 and showing the removed cover positioned to one side of the pump and exposing the cavity-forming surface of the cover.
Figure 4:
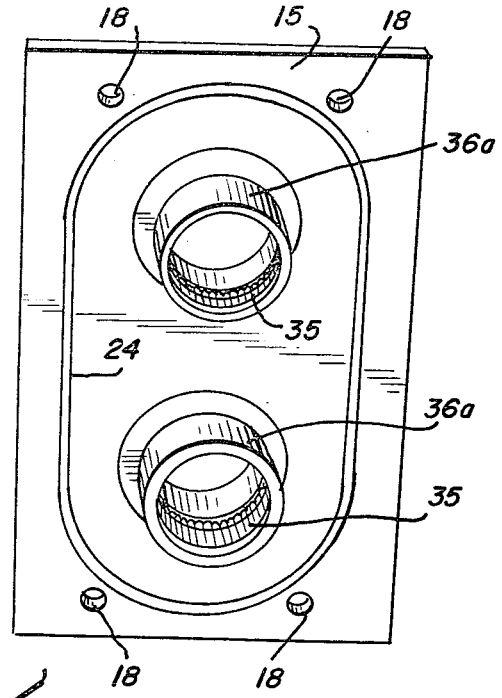
Figure 5:
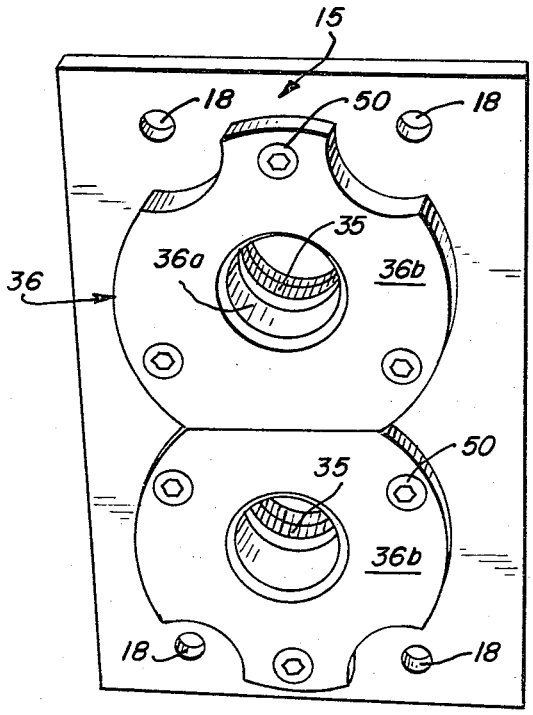
FIG. 5 is a perspective view of the removed cover shown in FIG. 4 but of the exterior surface thereof.

Referring now to the drawings and more particularly to FIG. 1, one form of an improved positive displacement rotary pump 10 is shown which is particularly suitable for handling a variety of heavy viscous products at high pumping pressures (e.g., 200–350 psi). Examples of products which are capable of being handled by pump 10 are as follows: meat emulsions, chopped meats, bread dough, pizza dough, dough slurry, high flour content doughs, processed cheese, icings, gravy base and batter.

Various pumps have been provided in the past which were capable of handling these products when operating at pressures below 200 psi. When attempts were made, however, to operate such pumps at and above 200 psi, serious problems arose due to the substantial stress and strain imposed on the bearings, rotor shafts and rotors, and because of the demand for close tolerances to exist between various moving components. Furthermore, the number and configuration of the lobes formed on the pump rotors and the materials utilized in making the rotors also became important factors to be considered in an effort to reduce galling between the rotors and the walls defining the pump cavity. Such past efforts, however, were not successful because of the cost and difficulty in manufacturing the various components, the inordinate amount of maintenance and servicing required, and the time and labor required in assembling and disassembling the pump components for cleaning and/or servicing.

The pump 10 as seen in FIGS. 1 and 2 includes a housing 11 having an interior cavity 12 in which is uniformly positioned a pair of meshing rotors 13, 14. One side of the housing is provided with a cover 15 which is removably mounted on the remainder of the housing by a plurality of symmetrically arranged stud bolts 16 and nuts 17. The threaded ends of the bolts extend through suitable openings 18 formed in the cover 15. The number and location of the stud bolts and the openings in the cover may readily vary from that shown, if desired.

The bolts 16 are anchored to and project from an end wall 20 which is disposed in spaced substantially parallel relation to cover 15 when the latter is assembled on the studs. The end wall 20 forms a part of a conventional drive gear casing 21 which will be described more fully hereinafter. As seen more clearly in FIGS. 2 and 3, the end wall 20 is provided with outwardly extending cylindrical bosses 22 from which the studs 16 protrude. The bosses 22 serve as spacers between the drive gear casing 21 and the back wall 23 of the housing 11, see FIG. 1. The back wall of the housing is provided with a continuous peripheral flangelike wrapper **23*a* which extends transversely from the back wall towards the cover and abuts the interior surface of the cover when the latter is in assembled relation therewith. The surface of the cover which abuts wrapper 23*a* is provided with a continuous groove 24 in which is disposed a suitable seal 25 (e.g., an "O" ring). As seen in FIG. 1, the seal surrounds the outside of cavity 12** of the housing.

Extending from drive gear casing 21, through openings **23*b* formed in the housing back wall 23, and into cavity 12 is a pair of shafts 26, 27. The corresponding ends 26*a*, 27*a* of the shafts are supported by the housing cover 15 as will be described in detail hereinafter. A portion 26*b*, 27*b* of each shaft, which is disposed within the cavity 12, is provided with suitable splines. Mounted on the splined portion of each shaft is the rotor 13, 14. In the illustrated embodiment, each rotor is of like construction and is provided with internal splines which mesh with the shaft splines and with five radially extending symmetrically arranged lobes L. When the pump is assembled the lobes of the rotors mesh with one another so as to effect circulation of the product through the housing cavity when the rotors are rotating. The product will enter the cavity through an inlet, not shown, formed in wrapper 23*a*** and disposed to one side of the rotors and will be discharged therefrom through an outlet, not shown, formed in said wrapper and disposed on the opposite side of the rotors. The inlet and outlet are normally horizontally aligned with one another and disposed substantially equidistant from the axes of shafts.

Each shaft 26, 27 has a portion thereof disposed within the drive gear casing 21 and has secured thereto a drive gear 28. The gears are in meshing relation. Disposed axially on opposite sides of the drive gear are preloaded tapered roller bearings 30 of conventional design.

Figure 6:
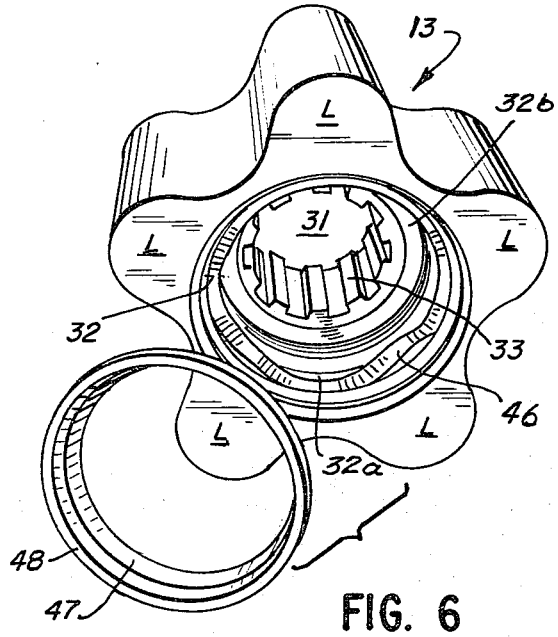
FIG. 6 is an enlarged perspective endface view of a removed rotor per se with the face seal therefor in disassembled relation; the view being of the endface which is adjacent the cover interior wall surface when the rotor is assembled in the pump cavity.

As aforementioned, the rotors 13, 14 are of like design and therefore only one will be described in detail. The rotor 13, as seen in FIG. 6, has an opening 31 formed therein to accommodate a substantial portion of the shaft 26, 27 protruding from the wall 20 of the drive gear casing 21. The end of opening 31 which terminates at the endface of the rotor disposed adjacent the cover 15, when the pump is assembled, is countersunk 32 a substantial amount. The end portion of opening 31 adjacent the opposite endface of the rotor is defined by internal splines 33 which are adapted to closely mesh with the splined portion **26*b*, 27*b* of the shaft 26, 27. As seen in FIG. 1, the countersinking 32 of opening 31, which extends to approximately the transverse center line of the rotor, is partially stepped so as to form shoulders 32*a* and 32*b* and an internal groove 32*c*** located between the shoulders.

The opposite endface of the rotor is provided with a groove 33 which is spaced from and concentric with the splined end of opening 31. Groove 33 is adapted to accommodate a suitable spring 34, the latter being used to maintain pressure on the face seal sections while awaiting product pressure during start-up.

As previously noted, the protruding end **26*a*, 27*a* of the shaft 26, 27 is supported by cover 15 through a roller bearing 35 carried by a retainer 36. The retainer 36 includes a sleevelike section 36*a* which encompasses and is in shrunk-fit relation with the raceway of bearing 35. The section 36*a* projects into the countersunk portion 32 of opening 31 and thus locates the bearing 35 between the planes defined by the cavity-forming surfaces of cover 15 and housing back wall 23, see FIG. 1**.

Surrounding the shaft end portion **26*a*, 27*a* and disposed within the retainer sleeve section 36*a* is a cylindrical liner 37. The inner end of the liner is provided with a flange 37*a* which abuts shoulder 32*b* formed in the countersunk portion 32 of opening 31. Liner 37 is provided with a plurality of circumferentially spaced openings 37*b*. The openings 37*b* are substantially aligned with the roller bearing 35** and thus enable the bearing to be lubricated.

As seen more clearly in FIG. 3, lubrication for the bearing 35 is attained through a conventional grease fitting 38 which is affixed to and extends axially from the end of the shaft 26, 27. The fitting 38 communicates with one end of an axial bore 40 formed in the end of the shaft. The inner end of bore 40 terminates in a radially extending passage 41. The outer end of the passage terminates at an annular groove 42 formed on the interior surface of the liner 37. Groove 42 is aligned with the liner openings **37*b* which in turn are aligned with bearing 35. To prevent leakage of grease, or similar lubricant, into the housing cavity 12, a first seal 45 is positioned in groove 32*c* formed in the countersunk portion 32 of opening 31, and a spring 46 is positioned against shoulder 32*a*. Spring 46 resiliently engages an inner section 47 of a face seal which in turn engages an outer section 48 of the seal, see FIGS. 1 and 6. The spring 46 and inner section 47 of the face seal rotate with the shaft while the outer section 48 of the face seal remains in a stationary position. The face seal section 48 is held in place by a flange section 36*b*, the latter being integral with the outer end of sleeve section 36*a* and forming a part of retainer 36. A substantial part of flange section 36*b* is disposed on the exterior of cover 15 and is removably secured to the latter by a plurality of bolts 50**.

As seen in FIG. 1, a protective cap C is removably mounted on flange section **36*b* and serves to protect grease fitting 38** when the latter is not to be used.

The liner 37, which encompasses the portion of the shaft disposed within the countersunk portion 32, is held in place against endwise movement by a caplike washer 51, the latter encompassing a shank of a bolt 52 which is threaded into the end of the axial bore 40 formed in the shaft. As seen in FIG. 1, the washer 51 is provided with a lug 51*a* which fits into a keyway 53 formed in the end of liner 37 and the end of the shaft 26, 27. Thus, by reason of this arrangement, the liner 37, washer 51, bolt 52 and grease fitting 38 will rotate as a unit with the shaft 26, 27.

The pressure from the tightened bolt 52 holds the liner 37 firmly against the shoulder 32*b* of the rotor 13 which in turn is held against a shaft shoulder 26*c* and thus prevents lateral movement of the rotor within the cavity 12. By reason of this arrangement galling between the rotor and cavity walls is avoided.

Pump 10 is provided with means for circulating a flushing media between the exterior of the retainer sleeve section 36*a* and a substantial part of the countersunk portion 32 of the rotor opening 31, without requiring even partial disassembly of the pump components. A radially extending passage 54, see FIG. 1, is formed within the flange section 36*b* of the retainer and then the inner end of the passage terminates at a second passage 55, which is also formed within the flange section. Passage 55 terminates adjacent the face seal section 48, thereby enabling a flushing fluid to circulate about face seal sections 47, 48, groove 32*c* and seal 45.

It will be noted in FIG. 1 that by reason of the depth of the countersinking of the opening 31, the center line of bearing 35 is located between the interior faces of cover 15 and back wall 23. Such a relationship is important because there is a close proximity (e.g., 1") of the center line of bearing 35 relative to the transverse center line L of the rotors 13, 14, and thus the mechanical advantage is greatly improved. By mechanical advantage is meant the ratio of a resistance to an applied force. In determining the mechanical advantage the distance from the center line of the nearest bearing to the center line L of the rotors 13, 14 is normally squared. Thus, if in the pump illustrated in FIG. 1, the bearing 35 for each shaft was eliminated and only the bearings 30 embodied in the drive gear casing 21 were utilized, the distance between the center line of the left bearing 30 (FIG. 1) and the rotor center line would be approximately 4.75". It is apparent therefore with the same applied load that pump 10 with bearing 35 in place would have a mechanical advantage in the magnitude of 22.6 to 1 as compared to the pump without bearing 35.

As aforementioned, the inboard faces of the rotors are each provided with a groove 33 in each of which is disposed a spring 34. Spring 34 resiliently engages a face seal section 57 which extends into groove 33. Section 57 in turn resiliently engages a second section 58 of the face seal. The outwardly disposed side of section 58 is engaged by a back member 60 which loosely encompasses the shaft 26, 27. The back member 60 is removably secured to the back wall 23 of the housing by a plurality of symmetrically arranged bolts 61. Thus, spring 34 and back member 60 coact to maintain the face seal sections 57, 58 in a static sealing contact. The bosses 22, from which the stud bolts 16 extend, provide adequate spacing between housing 11 and casing 21 to accommodate the members 60. Various other conventional seals 62 (including face seals) are provided which encompass each shaft and are disposed between the back member 60 and the front wall of casing 21, see FIG. 1.

Each back member 60 is provided with internal passages, not shown but similar to passages 54, 55 formed in flange section 36*b* of retainer 36, through which a suitable flushing media may be circulated. The circulating media would contact the rotor groove 33, spring 34, face seal sections 57, 58, and back member 60 due to clearance between such components and the portion of the shaft encompassed thereby. The circulating media, however, is blocked from the atmosphere by the conventional seals 62.

Where the product being circulated by the pump 10 is a food product, the matter of contamination by the lubricant and/or flushing media must be avoided. In addition to the numerous seals heretofore described as being utilized, various provisions are made that migration of such lubricant and/or flushing media is to the atmosphere rather than to the housing cavity 12. To facilitate such migration a passage 63 is provided adjacent the outwardly facing end of bearing 35.

As seen in FIG. 1, the tapered roller bearings 30 located within the gear casing 21 are pre-loaded by adjustable nuts 64 which are threaded into opposite sides of the casing. Each nut 64 engages one end of the bearing raceway 30*a* and the opposite end of bearing engages a shoulder formed on the shaft.

While the illustrated pump embodies 5-lobe rotors, it is to be understood that the invention is not intended to be limited thereto.

Thus, an improved positive displacement rotary pump has been provided which is readily capable of operating at high pressures and to circulate various viscous products. the improved pump is of sturdy compact construction and may be readily serviced when required, and provides an effective means of avoiding contamination of the product by lubricants and/or flushing media.

I claim:

1. A positive displacement rotary pump for circulating a viscous product, comprising a housing having an interior cavity through which the product is pumped, one wall of said cavity being defined by a removable cover; a pair of spaced substantially parallel shafts extending into said cavity, each shaft having one end thereof supported by said cover and a second end extending through a wall of said cavity opposite said cover; first means for driving and supporting the second ends of said shafts; meshing rotors mounted on said shafts, each rotor having internal means in driving engagement with said shaft on which the rotor is mounted, said internal means being located between planes defined by opposing walls forming the cavity, said rotors being disposed entirely within said cavity, the endface of each rotor adjacent said shaft one end having a substantial countersunk portion with a terminus adjacent said rotor internal means; bearing means substantially isolated from the product and disposed entirely within the countersunk portion of said rotor and supportingly engaging segments of said shaft one end, said bearing means having at least a portion thereof disposed adjacent the rotor internal means; and second means fixedly carried by said cover and extending into said countersunk portion and supporting said bearing means; each shaft being provided with an exterior shoulder adjacent the cavity-forming surface of the wall opposite said cover and against which one endface of a rotor engages and adjustable means carried on said shaft and spaced from said shoulder for engaging said rotor whereby the shoulder and adjustable means coact to restrain relative movement of said rotor on said shaft; said adjustable means including an elongated liner disposed within the countersunk portion and encompassing a segment of the shaft, one end of the liner abutting the terminus of the rotor countersunk portion, and a longitudinally adjustable element removably mounted on the shaft one end and engaging an opposite end of said liner and retaining the latter in abutting relation with said rotor terminus.

* * * * *

UNITED STATES PATENT AND TRADEMARK OFFICE

CERTIFICATE OF CORRECTION

PATENT NO. : 4,293,290

DATED : October 6, 1981

INVENTOR(S) : Victor E. Swanson

It is certified that error appears in the above—identified patent and that said Letters Patent is hereby corrected as shown below:

Column 1, lines 51-52
"productcompatible" which is one word should be
-- product-compatible --.

Column 5, lines 30 and 35
"L" should be
-- ℓ --.

Column 6, line 24
"the" should be
-- The --.

Signed and Sealed this

*Ninth* Day of *February 1982*

[SEAL]

*Attest:*

GERALD J. MOSSINGHOFF

*Attesting Officer*

*Commissioner of Patents and Trademarks*